US008803590B2

(12) United States Patent
Luo et al.

(10) Patent No.: US 8,803,590 B2
(45) Date of Patent: Aug. 12, 2014

(54) HIGH SPEED LOW POWER FUSE CIRCUIT

(75) Inventors: Zhihong Luo, Singapore (SG); On Au Yeung, Singapore (SG); Bai Yen Nguyen, Singapore (SG); Benjamin Lau, Singapore (SG)

(73) Assignee: Globalfoundries Singapore Pte. Ltd., Singapore (SG)

( * ) Notice: Subject to any disclaimer, the term of this patent is extended or adjusted under 35 U.S.C. 154(b) by 43 days.

(21) Appl. No.: 13/558,356

(22) Filed: Jul. 26, 2012

(65) Prior Publication Data

US 2014/0028381 A1 Jan. 30, 2014

(51) Int. Cl.
*H01H 37/76* (2006.01)

(52) U.S. Cl.
USPC ..... 327/525; 365/225.7

(58) Field of Classification Search
USPC ..... 327/525; 365/225.7
See application file for complete search history.

(56) References Cited

U.S. PATENT DOCUMENTS

| | | | | | |
|---|---|---|---|---|---|
| 6,054,893 | A * | 4/2000 | Singh | 327/525 |
| 6,134,159 | A * | 10/2000 | Sekino | 365/200 |
| 6,166,974 | A * | 12/2000 | Hsien et al. | 365/200 |
| 6,345,003 | B1 * | 2/2002 | Choi | 365/200 |
| 7,012,827 | B2 * | 3/2006 | Chung | 365/94 |
| 7,200,064 | B1 * | 4/2007 | Boerstler et al. | 365/225.7 |
| 7,221,210 | B2 * | 5/2007 | Parker et al. | 327/525 |
| 7,489,536 | B2 * | 2/2009 | Kawashima et al. | 365/96 |
| 7,529,147 | B2 * | 5/2009 | Ueda | 365/225.7 |
| 7,567,449 | B2 * | 7/2009 | Paak et al. | 365/96 |
| 7,830,736 | B2 * | 11/2010 | Hojo et al. | 365/200 |
| 2004/0046601 | A1 * | 3/2004 | Jung et al. | 327/525 |
| 2006/0197178 | A1 * | 9/2006 | Chung | 257/528 |

* cited by examiner

*Primary Examiner* — Thomas J Hiltunen
(74) *Attorney, Agent, or Firm* — Horizon IP Pte. Ltd.

(57) ABSTRACT

A fuse circuit having a fuse unit cell containing two fuses. In the program/write mode, only one of the fuses in the fuse unit cell will be blown. In read mode, since only one fuse is blown, the current that goes through the two fuses in the fuse unit cell will be very small. Hence, the read power consumption for the fuse circuit is also very small and its sensing speed is also very high.

20 Claims, 5 Drawing Sheets

100

HIGH SPEED LOW POWER FUSE CIRCUIT

BACKGROUND

Electrical programmed fuses ("eFuses") are widely used in semiconductor integrated circuits (ICs). An eFuse has two states, blown and unblown. Generally, an unprogrammed eFuse is in the unblown state while a programmed eFuse is in the blown state. A sensing circuit is employed to sense the state of the eFuse.

In conventional eFuses, a reference resistor is used. The reference resistor has a resistance which is equal to the midpoint between the resistance of a blown fuse and that of an unblown fuse. The sense circuit senses whether the fuse resistance is greater or smaller than resistance of the resistor.

However, the use of a resistor is sensitive to process and temperature variations. For example, the value of the resistor may vary due to process variations as well as temperature variations, resulting in a narrow sensing window. Furthermore, conventional fuse circuits have large power consumption as well as slow sensing speed.

From the forgoing discussion, it is desirable to provide a fuse circuit which has a large sensing window and high sensing speed with low power consumption.

SUMMARY

Embodiments relate to fuse circuits. In one embodiment, a fuse circuit includes a fuse unit cell. The fuse unit cell includes first and second fuses and a fuse controller for programming/writing the fuse unit cell. The fuse controller receives fuse programming control input signals to blow one of the first and second fuses while the other of the first and second fuses remain unblown. When the first fuse is blown and the second fuse is unblown, the fuse unit cell represents a first state; and when the first fuse is unblown and the second fuse is blown, the fuse unit cell represents a second state.

In another embodiment, a plurality of fuse circuits with fuse unit cells containing two fuses may be part of a macro memory array structure. For the macro structure, each column has two program selection signals. The output signals for each fuse unit cell in a column are connected together. At each read cycle, only one row will be selected for read, so only one fuse unit cell's output in each column will be selected. The other unselected fuse unit cells will be in high resistance.

These and other advantages and features of the embodiments herein disclosed, will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis is instead generally being placed upon illustrating the principles of the embodiments. In the following description, various embodiments are described with reference to the following drawings, in which.

DETAILED DESCRIPTION

Embodiments relate to fuse circuits. The fuse circuits can be incorporated into ICs. In particular, the fuse circuits can be easily incorporated into ICs using standard CMOS processing technologies. The ICs can be any type of IC, for example dynamic or static random access memories, signal processors, or system on chip devices. Other types of ICs are also useful.

Figure 1A:
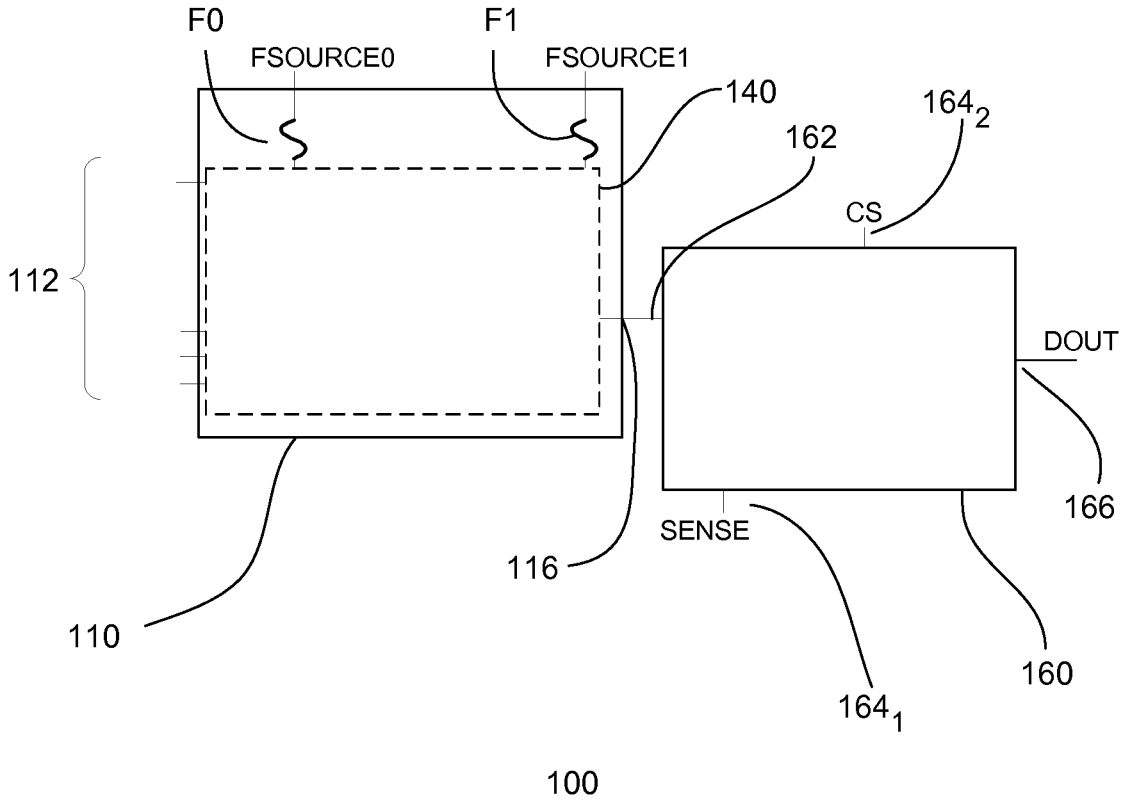
FIG. 1*a* shows a block diagram of an embodiment of a fuse circuit.

FIG. 1*a* shows a block diagram of a fuse module 100. As shown, the fuse module includes a fuse unit cell 110 and a sensing circuit 160. In one embodiment, the fuse unit cell includes first and second fuses F0 and F1. The fuses include first and second fuse terminals. FSOURCE0 is coupled to the first fuse terminal of F0 and FSOURCE1 is coupled to the first fuse terminal of F1.

The fuses, in one embodiment, are eFuses. An eFuse is blown by flowing a sufficient amount of current through its fuse terminals for a prescribed or certain period of time. The fuses are used to represent a first or a second logic state of the fuse unit cell. The first state, for example, may be a logic 1 and the second state may be a logic 0. Accordingly, two fuses are employed to determine whether the fuse unit cell is in a first or a second state. The fuse unit cell state is provided at a fuse unit cell output 116.

The fuse unit cell includes a fuse controller 140. The fuse controller receives control signals at the fuse unit cell control inputs 112. Based on the control signals, the fuse controller causes the fuse unit cell to be in a first or a second mode. The first mode, for example, is a program mode while the second mode is a read mode.

In the program mode, FSOURCE0 and FSOURCE1 are coupled to a program power supply. The program power supply is the power supply used for programming the fuse unit cell. For example, the program power supply is used to blow fuses. In one embodiment, the program power supply is a separate power supply from $V_{dd}$. The program power supply is, for example, a high power source.

The magnitude of the program power supply may be selected based on, for example, design requirements, such as fuse blow or program time. Other types of program power supply may also be useful. Based on the control signals, one of the fuses is blown and the other is unblown. A fuse is blown by connecting its second fuse terminal to a low power source. The low power source, for example, may be ground or $V_{ss}$. Other low power sources may also be useful.

When a fuse's second fuse terminal is connected to a low power source, a short between the program power supply and $V_{ss}$ results, blowing the fuse. In one embodiment, the second fuse terminal of the fuse to be blown is coupled to the low power source while the second fuse terminal of the fuse which should remain unblown is floated. Only one fuse will be blown, the other will be kept unblown after the programming procedure. Depending on which fuse is blown and which fuse is unblown, the fuse unit cell is in the first or second state.

In the read mode, one of the fuse's first fuse terminal is coupled to a low power source, such as $V_{ss}$, while the other fuse's first fuse terminal is coupled to a high power source, such as $V_{dd}$. For example, the first fuse terminal of the first fuse is coupled to $V_{dd}$ and the first fuse terminal of the second fuse is coupled to $V_{ss}$. The second fuse terminals of the fuses are coupled to the fuse unit cell output. Depending on which fuse is blown and unblown, $V_{dd}$ or $V_{ss}$ is provided at the fuse unit cell output corresponding to the first or the second fuse unit cell state. The power sources used in the program and read modes may be the same. However, it is understood that the power sources used in program and read mode need not necessary be the same.

Table 1 shows an example of the state of the fuse unit cell based on the conditions (blown or unblown) of the fuses.

TABLE 1

| F0 | F1 | Cell State |
|---|---|---|
| Blown | Unblown | 0 |
| Unblown | Blown | 1 |

The fuse unit cell state depicted in Table 1 may correspond to the case where the first fuse's first terminal is coupled to $V_{dd}$ and the second fuse's first terminal is coupled to $V_{ss}$. Providing other fuse conditions corresponding to fuse unit cell states may also be useful.

The sense circuit, in one embodiment, is a latch circuit for storing the state of the fuse unit cell. The sense circuit includes a sense circuit (SC) input terminal 162 and a SC output terminal 166. The SC input is coupled to the fuse unit cell output. At least one sense control input terminal is provided. Providing multiple sense control input terminals may also be useful, depending on the design requirements.

In one embodiment, the sense circuit is provided with first and second sense control input terminals $\mathbf{164}_{1\text{-}2}$. A sensing signal is provided at the first sense control input terminal while a chip select (CS) signal is provided at the second sense control input terminal. Active sensing and CS signals at the first and second sense control input terminals activate the sensing circuit. When activated, the state of the fuse unit cell is latched in the sensing circuit.

Illustratively, a fuse unit cell is associated with a sensing circuit. It is understood that a plurality of fuse unit cells may be associated with a sensing circuit. Other configurations of fuse unit cells and sensing circuits may also be useful.

As described, blown and unblown fuses are used to determine the state of the fuse unit cell. The resistance of a blown fuse is, for example, greater than 5 kΩ while the unblown fuse is less than 0.14 kΩ. Such a large resistance ratio produces a wide sensing margin. For example, a logic 1 state can be larger than 90% of the high power source (e.g., $V_{dd}$) while the logic 0 state can be smaller than 10% of the high power source. Such a wide sensing margin enables easy detection of the state of the fuse unit cell by using a simple latch in the sensing circuit as well as avoiding the need for a reference resistor. A less complex sensing circuit results in area savings. For example, the sensing circuit area may be reduced by over 30% compared to conventional sensing circuits.

Furthermore, a blown fuse always exists in the sensing path. The blown fuse produces a high resistance in the sensing path, which results in a small sensing current. For example, the current going through the first and second fuses is less than 200 μA in read mode. This may reduce power consumption in read mode by more than 60 percent as compared with other conventional eFuse circuits. Additionally, the small sensing current, along with a short read pulse, ensures that the unblown fuse remains intact.

Moreover, the fuse unit cell state, whether a logic 1 or logic 0, is being sensed out through an unblown fuse. As such, the sensing path for sensing the fuse unit cell has a very low resistance. This results in high sensing or read frequency. For example, the read frequency can be greater than 1 GHz for an output load of 0 pf while the read frequency can be greater than 500 MHz for an output load of 0.6 pf for all PVT corners. Furthermore, the present fuse unit cell is capable of sensing for all PVT corners using a low supply voltage, for example, down to as low as 0.75 V.

Figure 1B:
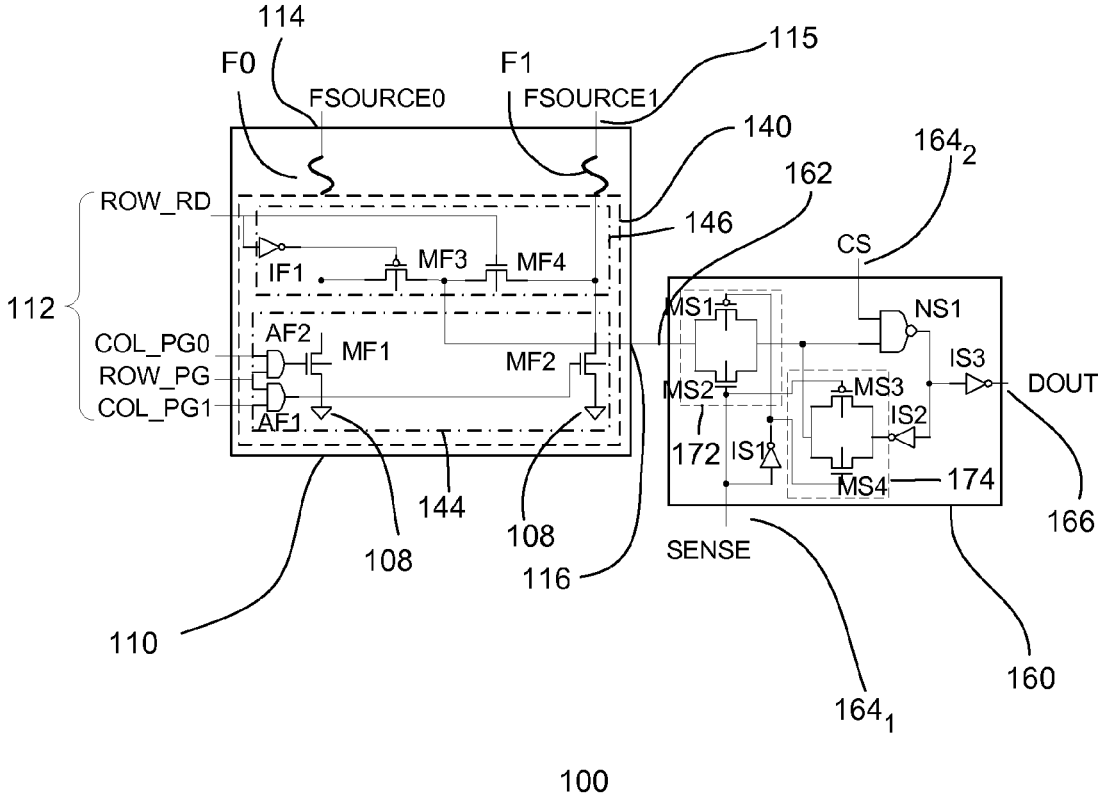
FIG. 1*b* shows a schematic diagram of an embodiment of a fuse circuit.

FIG. 1*b* shows a schematic diagram of an embodiment of a fuse module 100. The fuse module is similar to that described in FIG. 1*a*. As such, common elements may not be described or described in detail. The fuse module includes a fuse unit cell 110 and a sensing circuit 160.

The fuse unit cell includes first and second fuses F0 and F1. The fuses include first and second fuse terminals. In one embodiment, the first fuse terminal of the first fuse is coupled to a first fuse unit cell input 114 and the second fuse terminal is coupled to a low power source 108, such as $V_{ss}$. Other low power sources may also be useful. The first fuse terminal of the second fuse is coupled to a second fuse unit cell input 115 and the second fuse terminal of the second fuse is coupled to the low power source. The first fuse unit cell input, first fuse, and the low power source forms a first path between the first fuse unit cell input and the low power source; the second fuse unit cell input, second fuse and the low power source forms a second path between the second fuse unit cell input and the low power source.

A fuse unit cell control circuit 140 is disposed between the second terminals of the fuses and the low power source. The fuse unit cell control circuit receives fuse unit cell control signals at fuse unit cell control input terminals 112. The input control signals control the operating mode of the fuse unit cell. In one embodiment, the input control signals cause the fuse unit cell to operate in the program or read mode.

In one embodiment, the fuse unit cell control circuit includes a fuse program control sub-circuit 144. The fuse program control sub-circuit receives control signals for activating the fuse program control sub-circuit. Based on the control signals, the fuse program control sub-circuit determines which fuse to blow or not to blow. In one embodiment, the fuse program control sub-circuit includes a first transistor MF1 disposed in the first path between the first fuse and the low power source and a second transistor MF2 disposed in the second path between the second fuse and the low power source.

The transistors act as a switch. An activated switch couples a second terminal of a fuse to the low power source or an inactivated switch decouples or floats a second terminal of a fuse. In one embodiment, the transistors are n-type metal oxide semiconductor field effect transistors (nMOSFETs).

In one embodiment, the fuse program control sub-circuit receives a program control signal (PG) and first and second fuse program control signals (PG0 and PG1). The program control signal activates the fuse program control sub-circuit and the program control signals determines which fuse to blow and not to blow. Additionally, in the program mode, FSOURCE0 and FSOURCE1 are coupled to a high power source, such as $V_{dd}$. Other types of high power sources may also be useful.

For example, active PG, active PG0 and inactive PG1 signals cause the first fuse to be blown and the second fuse to be unblown. In such case, the first switch is on and the second switch is off. This causes a short between the high and low power source in the first path while no connection is made between the high and low power source in the second path. On the other hand, active PG, inactive PG0 and active PG1 signals cause the first fuse to be unblown and the second fuse to be blown. In such case, the first switch is off and the second switch is on. This causes a short between the high and low power source in the second path while no connection is made between the high and low power source in the first path.

To ensure that only one fuse is blown during programming, PG0 and PG1 are inverse signals when the fuse unit cell has been selected for programming. For example, one is active while the other is inactive. When a fuse unit cell is not selected for programming, both PG0 and PG1 will be 0 or inactive.

In one embodiment, the fuse program control sub-circuit includes first and second AND gates AF2 and AF1. The program control signals PG and PG0 are input to the first AND gate and PG and PG1 are input to the second AND gate. The output of the first AND gate is coupled to the gate of MF1 and the output of the second AND gate is coupled to the gate of MF2. With such a circuit configuration, the active program control signals are logic 1 signals and inactive program control signals are logic 0 signals.

Other configurations of active and inactive program control signals as well as circuit configurations of the fuse program control sub-circuit are also useful. For example, the active program control signals may be a combination of logic 1 and logic 0 signals. To ensure that only one fuse is blown during programming, PG0 and PG1 are inverse signals for the selected fuse unit cell. For example, one is active while the other is inactive.

In one embodiment, the fuse unit cell control circuit includes a fuse read control sub-circuit 146. The fuse read control sub-circuit receives an input control signal for activating the fuse read control sub-circuit. For example, the fuse read control sub-circuit receives a RD control signal. An active RD control signal activates the fuse read control sub-circuit. When activated, the fuse read control sub-circuit operates in the read mode. In the read mode, the second terminals of the first and second fuses are coupled to the fuse unit cell output. The fuse read control sub-circuit diverts the second fuse terminals to be coupled to the fuse unit cell output in the read mode.

In one embodiment, the fuse read control sub-circuit is disposed between the fuses and the fuse program control sub-circuit. The fuse read control sub-circuit includes third and fourth transistors MF3 and MF4. The third and fourth transistors are coupled in series between the second fuse terminals of the first and second fuses. The common terminal of the transistors is coupled to the fuse unit cell output. The transistors act as switches. In one embodiment, the transistors are opposite type MOSFETS. For example, one transistor is a p-type transistor and the other is an n-type transistor. In one embodiment, MF3 is a p-type transistor and the second transistor is an n-type transistor.

The gates of the transistor receive the RD signal. An active RD signal switches on the third and fourth transistor, coupling the second fuse terminals to the fuse unit cell output. The active RD signal, in one embodiment, is a logic 1 signal. In one embodiment, an inverter IF1 is provided. The input of the inverter is coupled to the RD signal and its output is coupled to the gate of MF3.

In one embodiment, the first fuse terminal of F0 is coupled to the high power source (e.g., $V_{dd}$) while the first fuse terminal of F1 is coupled to the low power source (e.g., $V_{ss}$) in the read mode. Depending on which fuse is blown and unblown, the output is provided with either the high or low power source. For example, if the first fuse is blown and the second fuse is unblown, the low power source is provided at the fuse unit cell output. On the other hand, if the first fuse is unblown and the second fuse is blown, the high power source is provided at the fuse unit cell output. The high and low power sources correspond to, for example, first and second fuse unit cell states.

In one embodiment, the activation signals for the fuse read and program control sub-circuits are inverse signals. For example, one is active while the other is inactive. For active signals which are of the same logical values, an inverter may be used to invert one of the signals. This ensures that only one of the fuse read and program control sub-circuits is active.

The sensing circuit, in one embodiment, includes a sense circuit (SC) input terminal 162 and a SC output terminal 166. The SC input is coupled to the fuse unit cell output. First and second sense control input terminals $\mathbf{164}_{1\text{-}2}$ are provided. A sensing signal is provided at the first sense control input terminal while a chip select (CS) signal is provided at the second sense control input terminal. Active sensing and CS signals at the first and second sense control input terminals activates the sensing circuit. When activated, the state of the fuse unit cell is latched in the sensing circuit. An inactive sense signal causes the sense circuit to be deactivated.

In one embodiment, the sensing circuit includes first and second transmission gates 172 and 174. The first transmission gate includes first and second sensing transistors MS1 and MS2 coupled in parallel. The transistors are opposite type MOSFETs. As shown, MS1 is a p-type transistor and MS2 is an n-type transistor. First common terminals of MS1 and MS2 form a first transmission gate input and second common terminals of MS1 and MS2 form a first transmission gate output. The second transmission gate includes third and fourth sensing opposite type transistors MS3 and MS4 coupled in parallel. For example, MS3 is a p-type transistor and MS4 is an n-type transistor. First common terminals of MS3 and MS4 form a second transmission gate input and second common terminals of MS3 and MS4 form a second transmission gate output.

In one embodiment, the first transmission gate input is coupled to the sensing input while the second transmission gate output is coupled to the first transmission gate output. The first sense control input is coupled to the gates of the transistors MS1, MS2, MS3, and MS4. The sense control input is configured to activate either the first or second transmission gate. For example, the sense control input is coupled to MS2 and MS3 while an inverted sense control input is coupled to MS1 and MS4 via inverter IS1.

The sensing circuit includes a sense NAND gate NS1. A first input of the NS1 is coupled to the second sense control CS and a second input is coupled to the first transmission gate output. The output of NS1 is coupled to sensing output by a second sensing inverter IS3 and to the second transmission gate input by a second sensing inverter IS2. The various components of the sensing circuit form a latch. For example, MS1, MS2, MS3, MS4, NS1, and IS3 form a latch.

When the sensing signal is active (e.g., logic 1), the first transmission gate is switched on while the second transmission gate is switched off. This causes data from the fuse unit cell to propagate to the NAND gate NS1. If CS is high, then this signal will also be propagated to DOUT though the NAND gate NS1 and inverter IS3. When the sensing signal is inactive (e.g., logic 0), the first transmission gate is off while the second transmission gate is on. NAND gate NS1 and inverter IS2 serve as a back to back inverter, maintaining the data captured from the fuse unit cell when sensing signal is active.

Figure 2:
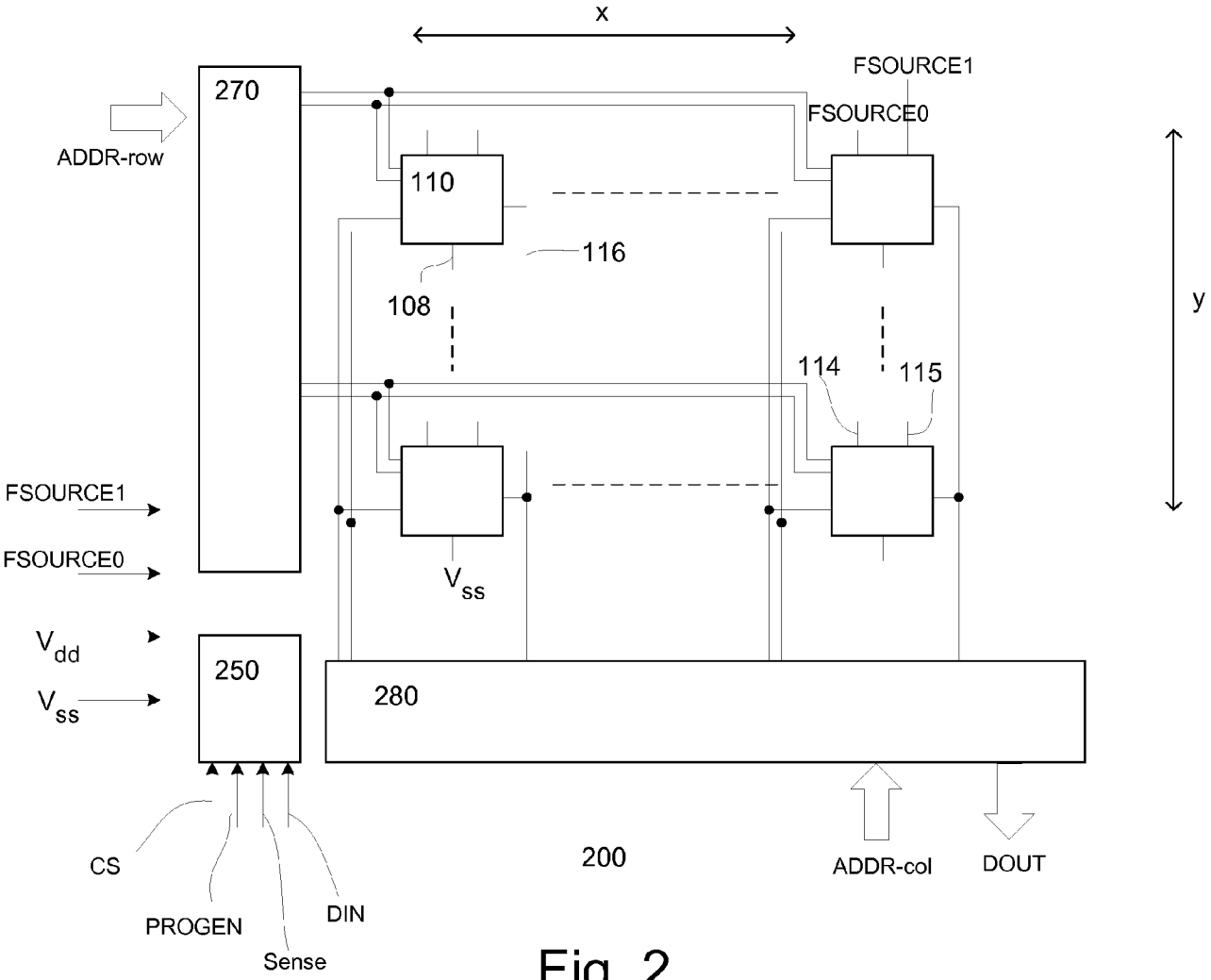
FIG. 2 shows a block diagram of an embodiment of a fuse macro structure.

FIG. 2 shows a block diagram of an embodiment of a fuse macro structure 200. The fuse macro structure includes a plurality of fuse unit cells 110. The fuse unit cells, for example, are similar to the fuse unit cells of the fuse modules described in FIGS. 1*a-b*. As such, common elements may not be described or described in detail. As shown, the fuse unit cells are arranged in an array. For example, the fuse unit cells are arranged in m rows and n columns. The rows are along the x-direction and the columns are along the y direction. The fuse macro structure may be employed for storing non-volatile information. For example, a fuse unit cell corresponds to a bit of data stored. In an alternative embodiment, the fuse macro structure may be used for storing address information for redundancy activation or defect replacement. Providing a fuse macro structure for other purposes may also useful.

The fuse macro structure includes row and column decoders 270 and 280 to facilitate accessing the fuse unit cells. An address (ADDR) is used to determine which fuse unit cell to access. The address, for example, includes a row portion (ADDR-row) and a column portion (ADDR-col). The row address is provided to the row decoder and the column address is provided to the column decoder. Based on the ADDR, the row decoder selects a row to access and the column decoder selects a column to access. The number of bits in ADDR should be sufficient to address the number of fuse unit cells. Each fuse unit cell corresponds to a bit. In the case of a 1024 bit fuse macro structure, a 10 bit ADDR is used. If the 1024 bit fuse macro structure is configured as a 64×16 array, the ADDR-row is 6 bits long while the ADDR-col is 4 bits long. Other configurations of fuse macro structures may also be useful.

Sense circuits are coupled to the columns of the fuse unit cells. In one embodiment, a sense circuit is provided for a column of fuse unit cells. For example, fuse unit cell outputs 116 of fuse unit cells from a column are commonly coupled to a sense circuit. The sense circuits, for example, are part of the column decoder block. Other configurations of column decoders and sense circuits may also be useful.

The macro structure may include a macro controller 250. The macro controller 250 receives macro control input signals. In one embodiment, the macro control input signals include the CS, program enable (PROGEN), sense and data in (DIN) input signals. The various macro control input signals is used to determine the operating mode and operations of the fuse macro structure.

The CS signal selects the chip associated with the fuse macro structure. An active CS signal activates the chip associated with the fuse macro structure. An inactive CS signal causes the chip associated with the fuse macro structure to be inactive. For example, an inactive CS signal renders the other control input signals ineffective.

With an active CS signal, the PROGEN signal dictates whether the fuse macro structure operates in the program or the read mode. For example, an active PROGEN signal causes the fuse macro structure to operate in the program mode while an inactive PROGEN signal causes the fuse macro structure to operate in the read mode.

In the program mode, the program signal (ROW_PG) of the selected row is active and the read signal (ROW_RD) is inactive. The row decoder selects a row based on the ADDR_row. The ROW_PG and ROW_RD signals of unselected rows are inactive. The first and second fuses' first fuse terminals are coupled to a program power supply.

The DIN signal determines which fuse to blow. For example the DIN signal causes one of the fuse program signals of the selected column, based on the ADDR_col, to be active while the other is inactive. For example, either COL_PG0 or COL_PG1 of the selected column is active while the other is inactive. The COL_PG0 and COL_PG1 for unselected columns are inactive. In one embodiment, a logic 0 DIN signal causes the first fuse to be blown while a logic 1 DIN signal causes the second fuse to be blown.

For example, a logic 0 DIN signal causes COL_PG0 to be active while CPL_PG1 to be inactive; a logic 1 DIN signal causes COL_PG0 to be inactive while CPL_PG1 to be active. An active fuse program signal couples the second fuse terminal of the fuse to the low power source, such as $V_{ss}$, while an inactive fuse program signal floats the second fuse terminal of the fuse. Other configurations of the DIN signals for blowing fuses may also be useful.

In the read mode, the information stored in the fuse unit cells of the selected row, based on the ADDR_row, is latched to the sensing circuits. In one embodiment, an active sense signal is provided to all the sense circuits associated with the selected row. The active sense signal outputs the data stored in the selected row of fuse unit cells in parallel as DOUT. For example, in the case where the array has 16 columns, 16 bits of data are output from the selected row of fuse unit cells as DOUT[0:15].

Figure 3A:
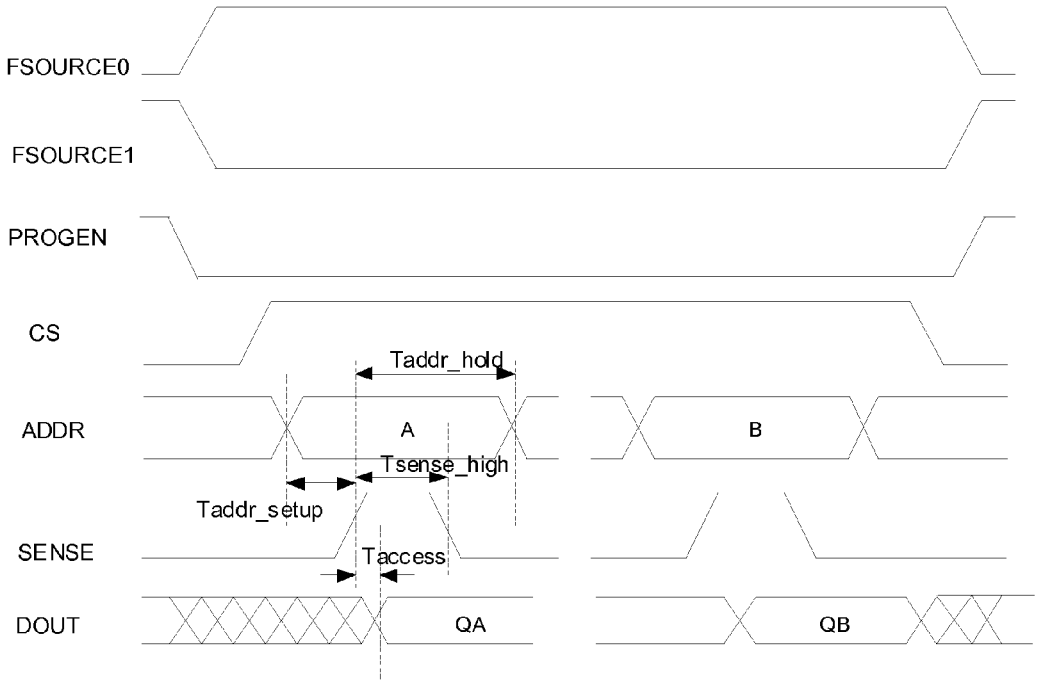
FIGS. 3*a-b* show embodiments of timing diagrams for read and program mode operations of the macro fuse structure.

FIG. 3*a* shows a timing diagram for a read operation in the read mode of an embodiment of a fuse macro structure, such as the one described in FIG. 2. In the read mode, the PROGEN signal is inactive (e.g., logic 0). An inactive PROGEN signal causes one of the fuse unit cell inputs (FSOURCE0 or FSOURCE1) to be coupled to the high power source, such as $V_{dd}$ and the other is coupled to the low power source, such as $V_{ss}$. In one embodiment, FSOURCE0 is coupled to the high power source and FSOURCE1 is coupled to the low power source.

An active CS signal causes an address (A) to be provided on the address bus ADDR. In one embodiment, CS is provided after PROGEN. This, for example, is to avoid unwanted programming. The address is valid for a sufficient period of time. The row portion of the address is provided to the row decoder and the column portion is provided to the column decoder.

An active sense signal is provided. In one embodiment, the active sense signal is provided after the address setup time Taddr_setup. This is to ensure that the decoders have time to decode the address. The sense signal, in one embodiment, is a positive pulse. The length of the pulse should be sufficient to enable the data to be read out onto the data bus (DOUT). For example, the length of the pulse may be as small as 1 ns.

Figure 3B:
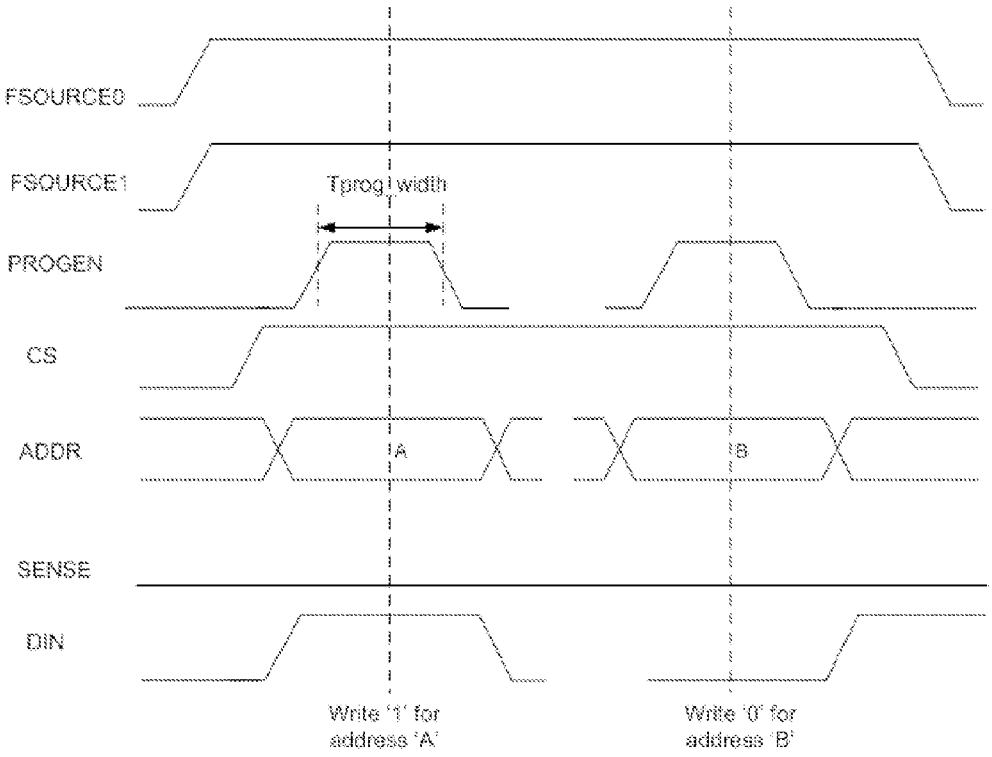

FIG. 3*b* shows a timing diagram for a program operation in the program mode of an embodiment of a fuse macro structure, such as the one described in FIG. 2. In the program mode, both the fuses' first terminals, which are connected to FSOURCE0 and FSOURCE1, respectively, are coupled to the program power source. When PROGEN is activated, the transistors MF1 and MF2 of the selected fuse unit cell are switched on, enabling the fuse unit cell to be programmed.

After an active CS signal, an address (A) is provided on the address bus ADDR. The address is valid for a sufficient period of time. The row portion of the address is provided to the row decoder and the column portion is provided to the column decoder. A DIN signal is also provided. An active DIN signal corresponds, for example, to a write "1" while an inactive DIN signal corresponds to a write "0"

An active PROGEN signal is provided after address setup time Taddr_setup to ensure that the decoders have time to decode the address. The PROGEN signal, in one embodiment, is a positive pulse. The pulse, for example, may be about 10 us. Other length of time may also be used as long as the positive pulse length is sufficient for one of the fuses to be blown, depending on DIN.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A fuse circuit comprising a fuse unit cell, wherein the fuse unit cell comprises:

first and second fuses;

a fuse controller for programming the fuse unit cell, the fuse controller receiving fuse programming control input signals for programming the fuse unit cell, the fuse controller programs the fuse unit cell by blowing one of the first and second fuses while the other of the first and second fuses remain unblown; wherein the blown fuse always exists in a sensing path and the blown fuse produces a high resistance in the sensing path thereby resulting in a small sensing current; and wherein when the first fuse is blown and the second fuse is unblown, the fuse unit cell represents a first state; and when the first fuse is unblown and the second fuse is blown, the fuse unit cell represents a second state.

2. The fuse circuit of claim 1 further comprising a sensing unit associated with the sensing path coupled to the fuse unit cell.

3. The fuse unit cell of claim 1 wherein the two fuses comprises two eFuses and are connected in parallel with each other.

4. The fuse unit cell of claim 1 further comprises:

a transistor connected in series with each of the fuses, the transistors being connected in parallel with each other.

5. The fuse unit cell of claim 4 wherein the transistor comprises NMOS transistors.

6. The fuse unit cell of claim 5 further comprises two transistors connected in series in between the first and second fuses and the respective NMOS transistors.

7. The fuse unit cell of claim 6 wherein one of the two transistors connected in series comprises a PMOS transistor and the other of the transistors connected in series comprises an NMOS transistor.

8. The fuse unit cell of claim 7 wherein an output of the fuse unit cell is taken from a node in between the PMOS and NMOS transistors.

9. The fuse unit cell of claim 3 wherein when the first eFuse is blown and the second eFuse is unblown, the first state represents a '0'; and when the first eFuse is unblown and the second eFuse is blown, the second state represents a '1'.

10. The fuse circuit of claim 1 wherein the sense unit has an access time of less than 1 ns.

11. The fuse circuit of claim 1 wherein the current going through the first and second fuses is less than 200 μA in read mode.

12. The fuse circuit of claim 1, wherein a plurality of the fuse unit cells may be utilized in a fuse macro structure to cause a read frequency of higher than about 1 GHz when the output load is 0 pf and a read frequency of higher than about 500 MHz when the output load is 0.6 pf, for all PVT corners.

13. A method of programming fuse circuits comprising:

providing a fuse circuit having a fuse unit cell with two fuses; and programming/writing the fuse unit cell by blowing only one of the two fuses while the other fuse always remain unblown, wherein the blown fuse always exists in a sensing path and the blown fuse produces a high resistance in the sensing path thereby resulting in a small sensing current, wherein depending on which fuse is blown, this represents a first or second state.

14. The method of claim 13 further comprising a read mode for detecting whether the fuse unit cell is in the first or second state; wherein the fuses comprises eFuses.

15. The method of claim 14, wherein the blowing of only one of the eFuses achieves faster speed and lower power consumption in the read state.

16. The method of claim 15 wherein reduction in the power consumption is by more than 60 percent compared to other conventional eFuse circuits.

17. The method of claim 13 further comprising coupling a sense unit associated with the sensing path to the fuse unit cell, the sense unit for sensing whether the fuse unit cell is in a first or second state.

18. The method of claim 17 wherein the sense unit has an access speed of less than 1 ns.

19. The method of claim 13 further comprising coupling a controller to the fuse unit cell, the controller for determining which of the eFuses should be blown.

20. A fuse circuit comprising a fuse unit cell, wherein the fuse unit cell comprises:

first and second fuses;

a fuse controller for programming the fuse unit cell, the fuse controller for receiving fuse programming control input signals for programming the fuse unit cell, the fuse controller programs the fuse unit cell by blowing one of the first and second fuses while the other of the first and second fuses remain unblown, wherein the blown fuse always exists in a sensing path and the blown fuse produces a high resistance in the sensing path thereby resulting in a small sensing current;

a sensing unit coupled to the fuse unit cell; and wherein when the first fuse is blown and the second fuse is unblown, the fuse unit cell represents a first state; and when the first fuse is unblown and the second fuse is blown, the fuse unit cell represents a second state.

* * * * *